US010535459B2

(12) United States Patent
Yoon et al.

(10) Patent No.: US 10,535,459 B2
(45) Date of Patent: Jan. 14, 2020

(54) COIL COMPONENT

(71) Applicant: SAMSUNG ELECTRO-MECHANICS CO., LTD., Suwon-si, Gyeonggi-do (KR)

(72) Inventors: Chan Yoon, Suwon-si (KR); Dong Hwan Lee, Suwon-si (KR); Young Ghyu Ahn, Suwon-si (KR)

(73) Assignee: SAMSUNG ELECTRO-MECHANICS CO., LTD., Suwon-si, Gyeonggi-do (KR)

( * ) Notice: Subject to any disclaimer, the term of this patent is extended or adjusted under 35 U.S.C. 154(b) by 459 days.

(21) Appl. No.: 15/290,172

(22) Filed: Oct. 11, 2016

(65) Prior Publication Data

US 2017/0243689 A1 Aug. 24, 2017

(30) Foreign Application Priority Data

Feb. 19, 2016 (KR) ..... 10-2016-0019464

(51) Int. Cl.
*H01F 17/00* (2006.01)

(52) U.S. Cl.
CPC ..... *H01F 17/0013* (2013.01)

(58) Field of Classification Search
CPC ..... H01F 27/324; H01F 17/0013
See application file for complete search history.

(56) References Cited

U.S. PATENT DOCUMENTS 6,384,705 B1 * 5/2002 Huang ..... H01F 17/0013 336/200
6,580,350 B1 * 6/2003 Kobayashi ..... H01F 17/0013 336/192
2003/0079904 A1 * 5/2003 Sato ..... H01C 1/028 174/126.4
2005/0218742 A1 * 10/2005 Kawarai ..... H01F 17/0013 310/179
2005/0229388 A1 * 10/2005 Deng ..... H01C 1/028 29/621
2010/0253464 A1 * 10/2010 Miyoshi ..... H01F 17/0013 336/200

(Continued)

FOREIGN PATENT DOCUMENTS

JP 2006-278479 A 10/2006
KR 10-2012-0023516 A 3/2012

(Continued)

OTHER PUBLICATIONS

Korean Office Action issued in corresponding Korean Patent Application No. 10-2016-0019464, dated Oct. 27, 2017, with English Translation.

(Continued)

*Primary Examiner* — Elvin G Enad
*Assistant Examiner* — Malcolm Barnes
(74) *Attorney, Agent, or Firm* — Morgan, Lewis & Bockius LLP

(57) ABSTRACT

A coil component includes: a body having coil portions disposed therein and exposed to one or more of surfaces of the body opposing each other in a width direction; external electrodes disposed on external surfaces of the body and connected to the coil portions; and insulating layers further disposed on the exposed coil portions.

18 Claims, 4 Drawing Sheets

(56) References Cited

U.S. PATENT DOCUMENTS

| | | | | |
|---|---|---|---|---|
| 2011/0006868 | A1* | 1/2011 | Banno | H01F 17/0013 336/200 |
| 2011/0254650 | A1* | 10/2011 | Banno | H01F 17/0013 336/200 |
| 2012/0032767 | A1* | 2/2012 | Iwasaki | H01F 17/0013 336/200 |
| 2012/0062348 | A1* | 3/2012 | Hashimoto | H01F 17/0013 336/192 |
| 2013/0222101 | A1* | 8/2013 | Ito | H01F 17/04 336/83 |
| 2014/0085038 | A1* | 3/2014 | Iwasaki | H01F 17/0013 336/221 |
| 2016/0276089 | A1* | 9/2016 | Inoue | B22F 7/04 |

FOREIGN PATENT DOCUMENTS

| | | | | |
|---|---|---|---|---|
| KR | 20150007448 | A * | 1/2015 | H01F 17/00 |
| KR | 10-2015-0080800 | A | 7/2015 | |

OTHER PUBLICATIONS

Office Action dated May 25, 2017 issued in Korean Patent Application No. 10-2016-0019464.

* cited by examiner

COIL COMPONENT

CROSS-REFERENCE TO RELATED APPLICATION(S)

This application claims benefit of priority to Korean Patent Application No. 10-2016-0019464 filed on Feb. 19, 2016 in the Korean Intellectual Property Office, the disclosure of which is incorporated herein by reference in its entirety.

TECHNICAL FIELD

The present disclosure relates to a coil component.

BACKGROUND

An inductor, a type of coil component, is a representative passive element constituting an electronic circuit, together with a resistor and a capacitor, to remove noise therefrom.

An inductor is manufactured by forming an internal coil portion in a body containing a magnetic material and then forming external electrodes on outer surfaces of the body.

In accordance with the miniaturization, slimming and multifunctionalization of electronic products, demand for the miniaturization and slimming of inductor components has also increased. A chip-type power inductor is mainly used in a power supply circuit, as a component such as a direct current (DC) to DC converter, provided within a portable device, and a chip-type power inductor having a small size, a high current, and a low DC resistance has been developed. In order to accomplish this object, there is a need to develop a power inductor having excellent DC bias characteristics in spite of having a small size.

SUMMARY

An aspect of the present disclosure may provide a coil component having excellent direct current (DC) bias characteristics by exposing coil portions in a body to the outside of the body and removing a margin portion for preventing the exposure of the coil portions.

According to an aspect of the present disclosure, a coil component may include: a body having coil portions disposed therein, wherein the coil portions are exposed to one or more of surfaces of the body opposing each other in a width direction; external electrodes disposed on external surfaces of the body and connected to the coil portions; and insulating layers disposed on the exposed coil portions.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Hereinafter, exemplary embodiments of the present disclosure will now be described in detail with reference to the accompanying drawings.

Hereinafter, a coil component according to an exemplary embodiment in the present disclosure, particularly, a thin film type inductor will be described. However, the coil component according to the exemplary embodiment is not limited thereto.

Figure 1:
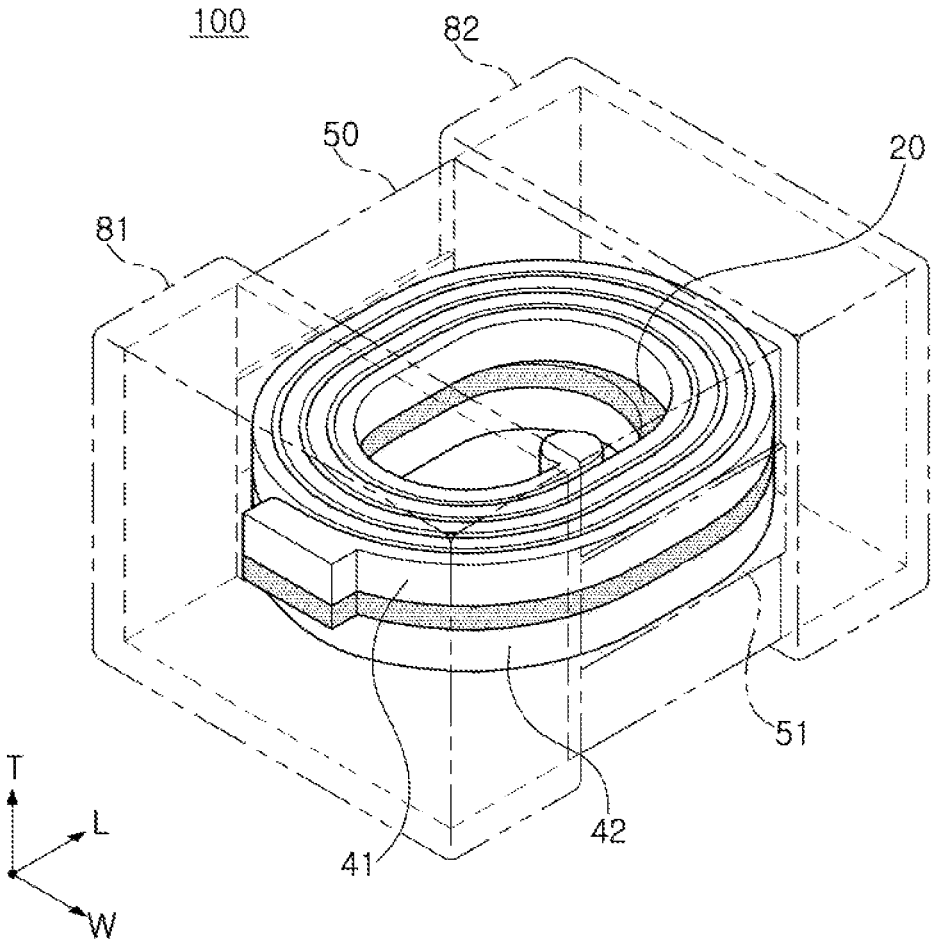
FIG. 1 is a schematic perspective view illustrating a coil component according to an exemplary embodiment in the present disclosure so that coil portions of the coil component are visible.

FIG. 1 is a schematic perspective view illustrating a coil component according to an exemplary embodiment in the present disclosure so that coil portions of the coil component are visible.

Referring to FIG. 1, a thin film type inductor used in a power line of a power supplying circuit is disclosed as an example of the coil component.

In the coil component 100 according to an exemplary embodiment in the present disclosure, a 'length' direction refers to an 'L' direction of FIG. 1, a 'width' direction refers to a 'W' direction of FIG. 1, and a 'thickness' direction refers to a 'T' direction of FIG. 1.

The coil component 100 according to an exemplary embodiment in the present disclosure may include a body 50, coil portions 41 and 42 embedded in the body 50, insulating layers 51 disposed on first and second side surfaces of the body 50, and external electrodes 81 and 82 disposed on external surfaces of the body 50 and connected to the first coil portion 41 and the second coil portion 42, respectively.

The body 50 of the coil component 100 according to an exemplary embodiment in the present disclosure may include a first coil portion 41 and a second coil portion 42 disposed therein.

The first coil portion 41 having a planar coil shape may be formed on one surface of an insulating substrate 20 disposed in the body 50, and the second coil portion 42 having a planar coil shape may be formed on the other surface of the insulating substrate 20 opposing one surface of the insulating substrate 20.

The first coil portion 41 and the second coil portion 42 may be formed on the insulating substrate 20 by performing electroplating, but are not limited thereto.

The first coil portion 41 and the second coil portion 42 may have a spiral shape, and the first coil portion 41 and the second coil portion 42 formed on one surface and the other surface of the insulating substrate 20, respectively, may be electrically connected to each other through a via (not illustrated) penetrating through the insulating substrate 20.

The first coil portion 41 and the second coil portion 42 and the via may be formed of a metal having excellent electrical conductivity, for example, silver (Ag), palladium (Pd), aluminum (Al), nickel (Ni), titanium (Ti), gold (Au), copper (Cu), platinum (Pt), or an alloy thereof, etc.

The first coil portion 41 and the second coil portion 42 may be coated with an insulating layer (not illustrated), such that they may not directly contact a magnetic material forming the body 50.

The insulating substrate 20 may be, for example, a polypropylene glycol (PPG) substrate, a ferrite substrate, a metal based soft magnetic substrate, or the like.

The insulating substrate 20 may have a through-hole formed in a central portion thereof to penetrate through the central portion thereof, wherein the through-hole may be filled with a magnetic material to form a core part 55. The core part 55 filled with the magnetic material may be formed, thereby improving an inductance (L).

However, the insulating substrate 20 is not necessarily included, and the coil portion may also be formed without the insulating substrate.

The first coil portion 41 and the second coil portion 42 may include coil pattern portions having a spiral shape and lead portions connected to end portions of the coil pattern portions and exposed to both surfaces of the body 50, respectively.

Figure 2:
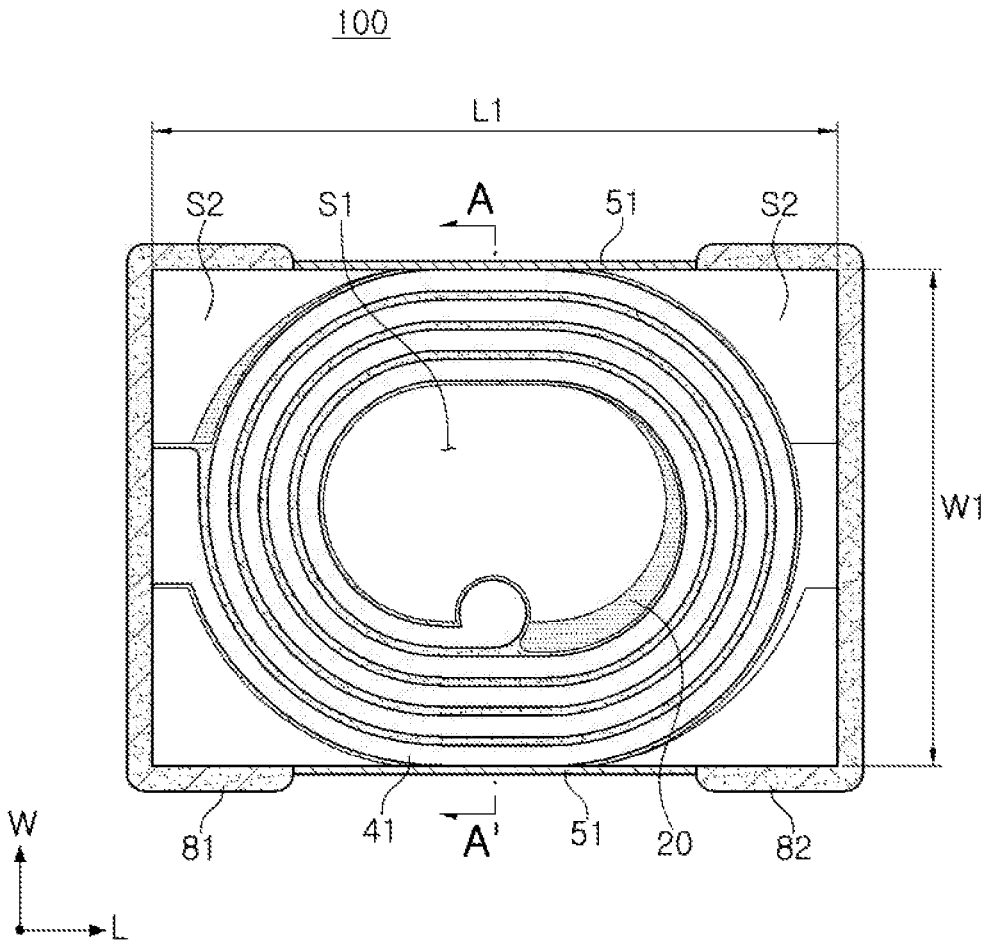
FIG. 2 is a plan view of the coil component of FIG. 1.

FIG. 2 is a plan view of the coil component of FIG. 1.

Referring to FIG. 2, the lead portions may be formed by extending one end portions of the coil pattern portions, and be exposed to both surfaces of the body 50 to thereby be connected to the first and second external electrodes 81 and 82 disposed on the external surfaces of the body 50.

For example, as illustrated in FIG. 2, the lead portion of the first coil portion 41 may be exposed to one end surface of the body 50 in the length (L) direction, and the lead portion of the second coil portion 42 may be exposed to the other end surface of the body 50 in the length (L) direction.

The body 50 of the coil component 100 according to an exemplary embodiment in the present disclosure may contain magnetic metal powder particles. However, the body 50 is not limited to containing the magnetic metal powder particles, but may contain any magnetic powder particles showing magnetic characteristics.

The magnetic metal powder particles may be a crystalline or amorphous metal containing one or more selected from the group consisting of iron (Fe), silicon (Si), boron (B), chromium (Cr), aluminum (Al), copper (Cu), niobium (Nb), and nickel (Ni).

For example, the magnetic metal powder particles may be an Fe—Si—B—Cr based amorphous metal.

The magnetic metal powder particles may be contained in a thermosetting resin such as epoxy, polyimide, or the like, in a form in which they are dispersed in the thermosetting resin.

The body 50 of the coil component 100 according to an exemplary embodiment in the present disclosure may have first and second end surfaces opposing each other in the length (L) direction, first and second side surfaces connecting the first and second end surfaces to each other and opposing each other in the width (W) direction, and upper and lower surfaces opposing each other in the thickness (T) direction.

According to an exemplary embodiment in the present disclosure, the first coil portion 41 and the second coil portion 42 may be exposed to one or more of surfaces of the body 50 opposing each other in the width direction.

Generally, an inductor has a predetermined distance, that is, a margin portion, formed from surfaces of the body opposing each other in the width direction to outer side portions of the coil portions in order to secure a volume of a magnetic material at the outer side portions of the coil portions and prevent exposure of the coil portions.

However, in a case in which the coil component is miniaturized and is required to have a high inductance, an area of an internal core part may not be sufficiently secured in order to secure the margin portion even though a line width of a coil is significantly decreased.

Therefore, a magnetic flux is saturated in the internal core part, such that direct current (DC) bias characteristics are deteriorated.

The DC bias characteristics, which are a current when an initial inductance value is decreased to a specific value or less due to application of a DC current in a power inductor, refers to a current at which an inductance is decreased from an initial inductance by 30%.

The decrease in the inductance depending on the DC current is due to a change in magnetic characteristics of a magnetic material. The magnetic material may store predetermined magnetic energy therein, but magnetic permeability and an inductance of the magnetic material are decreased in a region of the predetermined magnetic energy or more.

Generally, in the coil component, there is a limitation in a coil width that may be implemented in implementing a high inductance, and there is a problem that the turn of coils may also not be indefinitely increased in order to secure an area of the internal core part.

When the turn of coils is increased without considering the area of the internal core part, the magnetic flux is saturated in the internal core part, such that an inductance is decreased.

Due to the problem described above, there was a limitation in improving DC bias characteristics by securing an area of the internal core part in a given volume.

According to an exemplary embodiment in the present disclosure, the first coil portion 41 and the second coil portion 42 may be exposed to one or more of surfaces of the body 50 opposing each other in the width direction, whereby a coil component having excellent DC bias characteristics may be implemented.

In detail, the first coil portion 41 and the second coil portion 42 in the body 50 may be exposed to the outside of the body 50 to remove the predetermined thickness, that is, the margin portion, formed from the surfaces of the body opposing each other in the width direction to the outer side portions of the coil portions in order to prevent exposure of the coil portions, such that an area of the core part may be significantly secured, whereby a coil component having excellent DC bias characteristics may be implemented.

According to an exemplary embodiment in the present disclosure, the first coil portion 41 and the second coil portion 42 may be exposed to both surfaces of the body 50 opposing each other in the width direction, as illustrated in FIG. 2.

The insulating layers 51 may be disposed on the exposed coil portions 41 and 42.

The insulating layers 51 may contain a thermosetting resin.

For example, the insulating layers 51 may contain a thermosetting resin such as an epoxy resin, polyimide, or the like, but are not limited thereto. That is, the insulating layers 51 may contain any material having an insulating effect.

The insulating layers 51 may be formed by applying the thermosetting resin onto the first and second side surfaces of the body 50 in the width direction to which the first coil portion 41 and the second coil portion 42 are exposed and then hardening the thermosetting resin, but are not limited thereto.

That is, the insulating layers 51 may also be formed by coating an insulating material onto the first and second side surfaces of the body 50 in the width direction to which the first coil portion 41 and the second coil portion 42 are exposed.

The insulating layers 51 may further contain magnetic metal powder particles. The insulating layers 51 may further contain the magnetic metal powder particles, whereby a higher level of inductance may be implemented.

A content of magnetic metal powder particles contained in the insulating layers 51 may be 3 to 70 wt %.

In a case in which a content of magnetic metal powder particles contained in the insulating layers 51 is less than 3 wt %, an inductance increase effect may be insufficient, and in a case in which a content of magnetic metal powder particles contained in the insulating layers 51 exceeds 70 wt %, an inductance increase rate may be small and an appearance defects may occur.

The insulating layers 51 may be formed on the entirety of the first and second side surfaces of the body 50 in the width direction.

The insulating layers 51 may be formed on the entirety of the first and second side surfaces of the body 50 in order to effectively insulate the first coil portion 41 and the second coil portion 42 exposed to the first and second side surfaces of the body 50. However, the insulating layers 51 are not limited thereto, but may also be formed on portions of the first and second side surfaces of the body 50.

The insulating layers 51 may have a thickness less than 10 μm.

In a case in which a thickness t of the insulating layers 51 exceeds 10 μm, a volume occupied by the insulating layers 51 may be excessively increased, such that it may be difficult to miniaturize a coil component and implement a high inductance coil component.

Referring to FIG. 2, when an area of a cross section, in a length-width direction, of the core part 55 formed inside the first coil portion 41 and the second coil portion 42 is S1 and the sum of cross sectional areas, in the length-width direction, of the body 50 formed outside the first coil portion 41 and the second coil portion 42 is S2, S2<S1.

According to an exemplary embodiment in the present disclosure, since the coil components has a shape in which an area of the core part 55 formed inside the first coil portion 41 and the second coil portion 42 is significantly increased unlike a shape of a coil portion of a coil component according to the related art, the area S1 of the cross section, in the length-width direction, of the core part 55 formed inside the first coil portion 41 and the second coil portion 42 may be larger than the sum S2 of the areas of the cross section, in the length-width direction, of the body 50 formed outside the first coil portion 41 and the second coil portion 42.

Due to the structure described above, the area of the core part may be significantly secured, such that a coil component having excellent DC bias characteristics may be implemented.

In addition, according to an exemplary embodiment in the present disclosure, a ratio of a length W1 of a short side to a length L1 of a long side of the body 50 may be 0.6 or more.

Since the coil component has the shape in which the area of the core part 55 formed inside the first coil portion 41 and the second coil portion 42 is significantly increased unlike the shape of the coil portion of the coil component according to the related art, the ratio of the length W1 of the short side to the length L1 of the long side of the body 50 may be 0.6 or more.

In a case in which the ratio of the length W1 of the short side to the length L1 of the long side of the body 50 is 0.6 or more, the first coil portion 41 and the second coil portion 42 may have a shape close to a circular shape rather than an oval shape, which is a shape of a coil portion of a general coil component.

In a case in which the ratio of the length W1 of the short side to the length L1 of the long side of the body 50 is less than 0.6, the first coil portion 41 and the second coil portion 42 may have an oval shape similar to that of an inductor coil according to the related art, such that an improvement effect of DC bias characteristics may not be present.

Figure 3:
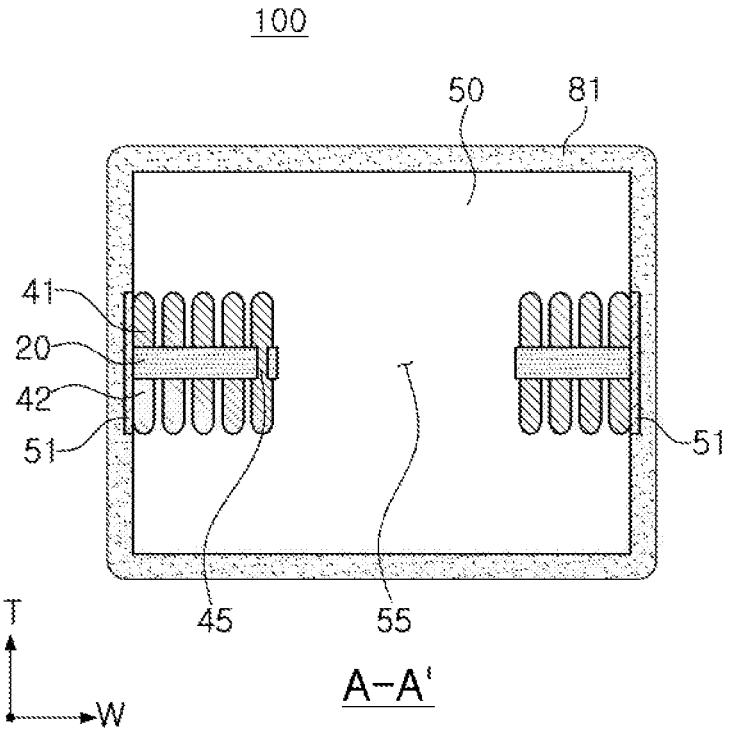
FIG. 3 is a cross-sectional view taken along line A-A' of FIG. 2.

FIG. 3 is a cross-sectional view taken along line A-A' of FIG. 2.

Referring to FIG. 3, the first coil portion 41 and the second coil portion 42 formed on one surface and the other surface of the insulating substrate 20, respectively, may be electrically connected to each other by a via 45 penetrating through the insulating substrate 20.

The first coil portion 41 and the second coil portion 42 may be exposed to both surfaces of the body 50 opposing each other in the width direction.

The insulating layers 51 may be disposed on the exposed first and second coil portions 41 and 42.

Figure 4:
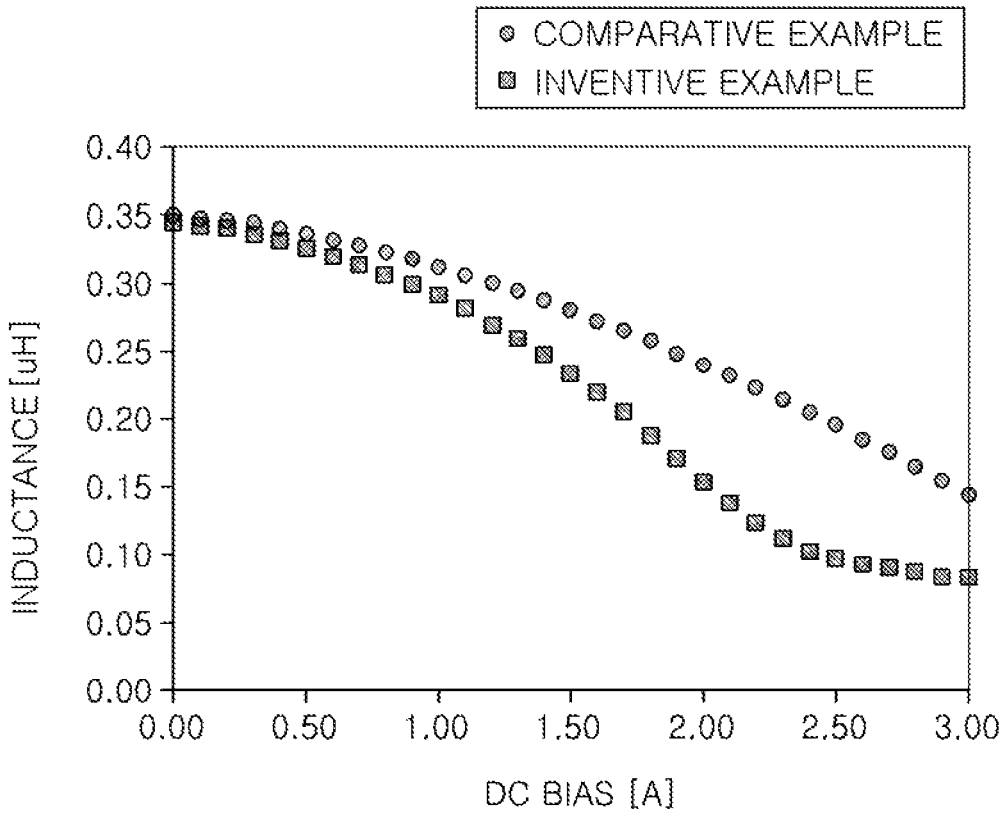
FIG. 4 is a graph for comparison between direct current (DC) bias characteristics according to an Inventive Example and a Comparative Example.

FIG. 4 is a graph for comparison between DC bias characteristics according to Inventive Example and Comparative Example.

In Inventive Example and Comparative Example, power inductors having a 1008 size and a thickness of 0.65 mm (that is, power inductors of which length×width×thickness is 1.0 mm×0.8 mm×0.65 mm) have been used.

In detail, power inductors according to Inventive Example and Comparative Example were manufactured so that widths of outer side portions of a coil adjacent to side surfaces of a body and widths of outer side portions of the coil adjacent to a core part were 40 μm in both the Inventive Example and the Comparative Example, widths of inner side portions of the coil disposed in the outer side portions were 30 μm in both the Inventive Example and the Comparative Example, and a thickness of the coil was 170 μm in the Inventive Example and was 160 μm in the Comparative Example.

In addition, the power inductors according to the Inventive Example and the Comparative Example were manufactured so that the turn of coil is 8.5 in both the Inventive Example and the Comparative Example.

The power inductor according to Inventive Example was manufactured to have a structure in which it does not include a margin portion (a width of the margin portion was 0 μm) by manufacturing coil portions so as to be exposed to side surfaces of the body in a width direction, and the power inductor according to Comparative Example was manufactured to have a structure according to the related art in which a width of a margin portion was 60 μm.

Inductance (L) was measured as 0.34109 μH in the Comparative Example, and was measured as 0.34504 μH in the Inventive Example.

A DC resistance value (Rdc) was measured as 56.30 mΩ in the Comparative example, and was measured as 56.66 mΩ in the Inventive Example.

A saturated current value (Isat) was measured as 1.45 A in the Comparative Example, and was measured as 1.95 A in the Inventive Example.

Referring to FIG. 4, it may be appreciated that DC bias characteristics have been improved by about 35% in the Inventive example in which the coil portions are disposed to be exposed to one or more of both side surfaces of the body in the width direction, according to an exemplary embodiment in the present disclosure as compared with the Comparative Example in which the predetermined distance, that is, the margin portion, is formed from the side surfaces of the body in the width direction to the outer side portions of the coil portions as in the structure according to the related art.

As set forth above, according to an exemplary embodiment in the present disclosure, the coil portions in the body are exposed to the outside of the body and the margin portion for preventing the exposure of the coil portions is removed, such that an area of the core part may be significantly secured, whereby a coil component having excellent DC bias characteristics may be implemented.

While exemplary embodiments have been shown and described above, it will be apparent to those skilled in the art that modifications and variations could be made without departing from the scope of the present invention as defined by the appended claims.

What is claimed is:

1. A coil component comprising:

a body having first and second end surfaces opposing each other in a length direction of the body, first and second side surfaces connecting the first and second end surfaces to each other and opposing each other in a width direction of the body, and upper and lower surfaces opposing each other in a thickness direction of the body;

coil patterns stacked in the body along the thickness direction, wherein the coil patterns are exposed to one or more of the first and second side surfaces of the body opposing each other in the width direction and are spaced apart from the first and second end surfaces opposing each other in the length direction;

lead portions extending from the coil patterns, respectively, and exposed to the first and second end surfaces in the length direction, respectively; and external electrodes disposed on the first and second end surfaces of the body and connected to the lead portions, respectively; and insulating layers disposed on the exposed coil patterns, wherein the insulating layers are disposed only on the first and second side surfaces of the body.

2. The coil component of claim 1, wherein S2<S1, where S1 is an area of a cross section, in a length-width direction, of a core part formed inside the coil patterns and S2 is a sum of cross sectional areas, in the length-width direction, of the body formed outside the coil patterns.

3. The coil component of claim 1, wherein the insulating layers contain a thermosetting resin.

4. The coil component of claim 3, wherein the insulating layers further contain magnetic metal powder particles.

5. The coil component of claim 1, wherein a thickness of each of the insulating layers is less than 10 μm.

6. The coil component of claim 1, wherein a ratio of a length of a short side to a length of a long side of the body is 0.6 or more.

7. The coil component of claim 1, wherein the coil patterns are exposed to both the first and second side surfaces of the body opposing each other in the width direction.

8. The coil component of claim 1, wherein the insulating layers are disposed between portions of the external electrodes.

9. The coil component of claim 1, wherein the coil patterns are exposed only to the one or more of the first and second side surfaces of the body opposing each other in the width direction, among the first and second side surfaces of the body opposing each other in the width direction and the upper and lower surfaces opposing each other in the thickness direction of the body.

10. The coil component of claim 1, wherein the insulating layers are spaced apart from the upper and lower surfaces opposing each other in the thickness direction of the body.

11. A coil component comprising:

a body having coil portions disposed therein, wherein the coil portions are exposed to one or more of surfaces of the body opposing each other in a width direction;

external electrodes disposed on external surfaces of the body and connected to the coil portions; and insulating layers disposed on the exposed coil portions, wherein a thickness of each of the entire insulating layers is less than 10 μm, and the insulating layers are disposed only on the surfaces of the body opposing each other in the width direction.

12. The coil component of claim 11, wherein S2<S1, where S1 is an area of a cross section, in a length-width direction, of a core part formed inside the coil portions and S2 is a sum of cross sectional areas, in the length-width direction, of the body formed outside the coil portions.

13. The coil component of claim 11, wherein the insulating layers contain a thermosetting resin.

14. The coil component of claim 13, wherein the insulating layers further contain magnetic metal powder particles.

15. The coil component of claim 11, wherein a ratio of a length of a short side to a length of a long side of the body is 0.6 or more.

16. The coil component of claim 11, wherein the coil portions are exposed to both surfaces of the body opposing each other in the width direction.

17. The coil component of claim 11, wherein the insulating layers are disposed between portions of the external electrodes.

18. The coil component of claim 11, wherein the insulating layers are spaced apart from upper and lower surfaces opposing each other in a thickness direction of the body along which the coil portions are stacked.

* * * * *